US006099666A

United States Patent [19]

Powell

[11] Patent Number: 6,099,666

[45] Date of Patent: Aug. 8, 2000

[54] VARIABLE COOLING RATE QUENCH METHOD AND APPARATUS

[76] Inventor: Joseph A. Powell, 655 S. Broadway, Akron, Ohio 44311

[21] Appl. No.: 09/122,914

[22] Filed: Jul. 27, 1998

[51] Int. Cl.[7] ..... C21D 1/64

[52] U.S. Cl. ..... 148/559; 148/500; 148/503; 148/511; 148/559; 148/579; 148/637; 148/638; 148/660; 148/661; 266/130; 266/131

[58] Field of Search ..... 148/500, 503, 148/511, 637, 638, 660, 661, 559, 579; 266/130, 131

[56] References Cited

U.S. PATENT DOCUMENTS

| | | | |
|---|---|---|---|
| 3,963,535 | 6/1976 | Lineberg | 148/144 |
| 4,419,149 | 12/1983 | Day | 148/131 |
| 4,596,612 | 6/1986 | Fradique | 148/18 |
| 5,094,702 | 3/1992 | Kothmann et al. | 148/128 |
| 5,529,290 | 6/1996 | Drager | 266/114 |
| 5,795,538 | 8/1998 | Abukawa et al. | 266/46 |
| 5,891,275 | 4/1999 | Elfmark et al. | 148/654 |

*Primary Examiner*—Daniel J. Jenkins
*Assistant Examiner*—Nicole Coy
*Attorney, Agent, or Firm*—Oldham & Oldham Co., LPA

[57] ABSTRACT

A variable rate quench system allows the cooling of a heated workpiece to be controlled more closely. A liquid quenchant used in the system has an initial temperature, density and heat extraction index. The system comprises a first tank containing the liquid quenchant and to receive the workpiece and a second tank communicated to the first tank. The first tank has a means for agitating the liquid quenchant around the workpiece and a supply of make-up liquid quenchant communicated thereto. The second tank has a slurry of a non-liquid solid phase quenchant modifier and a means for selectively controlling addition of the slurry to the first tank. A real time data acquisition system acquires and analyzes temperature, density and agitation rate of the liquid quenchant, calculates an instantaneous heat extraction index of the liquid quenchant and compares the difference between the calculated index and a predetermined ideal index. Corrective action to minimize the difference is then taken. The first tank is also provided with a means for cycling a portion of the quenchant in the first tank through a heat exchanger external to the first tank to maintain the tank in an isothermal condition.

13 Claims, 3 Drawing Sheets

LEGEND

- Ms = MARTENSITE START
- Q(f) = QUENCH (FAST)
- Q(i) = QUENCH (IDEAL)
- Q(s) = QUENCH (SLOW or SLACK)
- A = AUSTENITE
- C = CEMENTITE
- F = FERRITE
- P = PEARLITE
- B = BAINITE
- M = MARTENSITE

VARIABLE COOLING RATE QUENCH METHOD AND APPARATUS

The present invention relates to an apparatus and method for varying the cooling rate in a quench medium, as encountered in the heat treating industry. The method and apparatus permit the quench rate to be varied throughout the quench cycle in a single quench bath so that optimal physical properties of the material may be obtained. In order to achieve this objective, a method and apparatus for measuring and quantifying the instantaneous quench rate in situ is provided.

BACKGROUND OF THE INVENTION

In the heat treating of materials, particularly metals, it is well known that the path of time and temperature followed in the cooling or "quenching" of the material after a heat treatment is critical in optimizing the ultimate working properties of the material. For example, FIG. 1 shows an isothermal transformation diagram showing the various phases possible in quenching of a steel. The diagram itself has, temperature increasing linearly on the vertical axis and time increasing In a logarithmic manner along the horizontal axis. The specific diagram is constructed for a given isothermal quench bath under known agitation conditions. The material to be quenched starts off at an initial temperature 100 which is substantially higher than the martensite start temperature $M_s$, which is shown as line 102 in FIG. 1. Below this line, the material exists solely in the martensite ("M") phase. At the initial temperature 100, the material is essentially all in the austenite ("A") phase. The material may be converted in to a material which is all martensite through the quench process through a variety of routes. In one route, indicated as the "fast" quench, and identified in FIG. 1 as curve 104, the material is quickly dropped in temperature through a water or brine-based quench medium. In another pathway shown as curve 106, a "slow" or "slack" quench takes the material eventually to a martensite composition, but through a path which involves phase conversions which include ferrite and cemetite inclusions. This type of quench would be accomplished through a hot oil based quench medium. A more ideal quench pathway, shown as curve 108, would avoid the passage through the phase envelopes where ferrite ("F") and cementite ("C") phases accompany the austenite phase. These phase envelopes are defined by phase transition lines such as 110 and 112. In fact, it will be recognized that line 102 is itself a phase transition line. Although not shown in the particular phase diagram, it will be recognized by those of skill in this art that the phase diagram is not completely disclosed and that the area above line 102, there is also a potential for pearlite ("P") and bainite ("B") phases, although these are not shown in the present diagram.

In many situations in the prior art, the quench pathway would be effectively determined once the initial temperature of the particular body and the initial conditions of the quench tank and medium were set. This is because traditional quench media such as brine, water, polymer/water mixtures, oils, molten salts (such as marquenching or ausquenching), fluidized beds of particles, inert gas/air blast and still air, all have fixed cooling curves at a given bath concentration (or pressure), bath temperature and gill agitation rate. As a consequence, the quench practice known in the prior art has always been a compromise, with the treater trying to "fit" a fixed quenchant cooling curve or heat extraction index to either an isothermal transformation ("I-T") diagram of the type shown as FIG. 1 or a continuous cooling transformation ("CCT") curve of the specific material being quenched. The isothermal transformation diagram is so named because it depicts the cooling characteristics of a material in a quenchant which is maintained at an isothermal, or constant temperature, condition. The generation of a particular curve is dependent upon several factors, including the temperature of the quench medium, the geometry of the quench tank, the agitation rate in the tank and the inherent ability of the quench medium to extract heat from the workpiece.

There are known procedures in the prior art to vary the quench rate of a part formed from a heat-treatable material during the quench cycle. For example, an interruption of quenching, also known as "time quenching", involves the use of an initial rapid cooling step to achieve high hardness and then physically removing the part or material from the first quench bath and inserting it into a second quench bath containing a second quench medium, typically a less severe medium. This presents two problems. The first is the problem of knowing exactly when to interrupt the first quench. If interrupted too soon, the part receives a "slack quench" and does not achieve and full hardness is not achieved. If interrupted too late, the outside surface cools and transforms while the core or interior of the part is still too hot (above the martensite start temperature $M_s$) and the resultant phase discontinuity can result in increased distortion and possibly cracking. The second problem is the severe discontinuity in quench rate caused by ceasing the first quench cycle and exposing the part or material to air, one of the least severe possible quench media, until it can be immersed into a second quench medium.

Another known method of varying the quench rate is to vary the rate of agitation of a fixed quench medium. The problem in this latter situation is one of control. A good heat treater knows that quenching thinner parts of a material in a region of low agitation and quenching thicker parts in a region of high agitation can result in reduced distortion while maximizing hardness of the part. Insertion of temperature probes in the core of the part or doing pretreatment computer modeling allows one to vary the agitation rate. However, no amount of variance in the agitation rate can escape the inherent limitation of the ability of a given quenchant to absorb heat from the material.

SUMMARY OF THE INVENTION

It is therefore an object of the present invention to provide an apparatus and method for varying the quench rate of a medium in a single bath so that the effective quench rate in that bath may be controllably and effectively varied. This and other objects of the present invention are provided by a process for quenching a workpiece of a known material. The process comprises the steps of a) inserting the workpiece into a quench tank containing an initial charge of a liquid quenchant having an initial temperature, density and heat extraction index; b) collecting at least one set of data points from the tank, comprising quenchant temperature and density data points; c) calculating an instantaneous heat extraction index based upon the set of data points and calculating a deviation of the instantaneous heat extraction index at the known elapsed time from an ideal heat extraction index for the same elapsed time of quenching the material; d) taking corrective action to decrease the deviation; and e) removing the workpiece from the quenchant when a predetermined quench cycle is complete. Steps b) through d) will be repeated on an iterative basis as is deemed necessary to achieve the desired result.

BRIEF DESCRIPTION OF THE DRAWINGS

A better understanding of the present invention will be had when reference is made to the accompanying drawings, wherein identical parts are identified by identical reference numerals and wherein.

DETAILED DESCRIPTION OF THE PRESENT INVENTION

The intended quench technique of the present invention has already been described and illustrated with reference to FIG. 1, which shows a isothermal transformation diagram which has been constructed for a particular material under particular quench tank operations.

Figure 2:
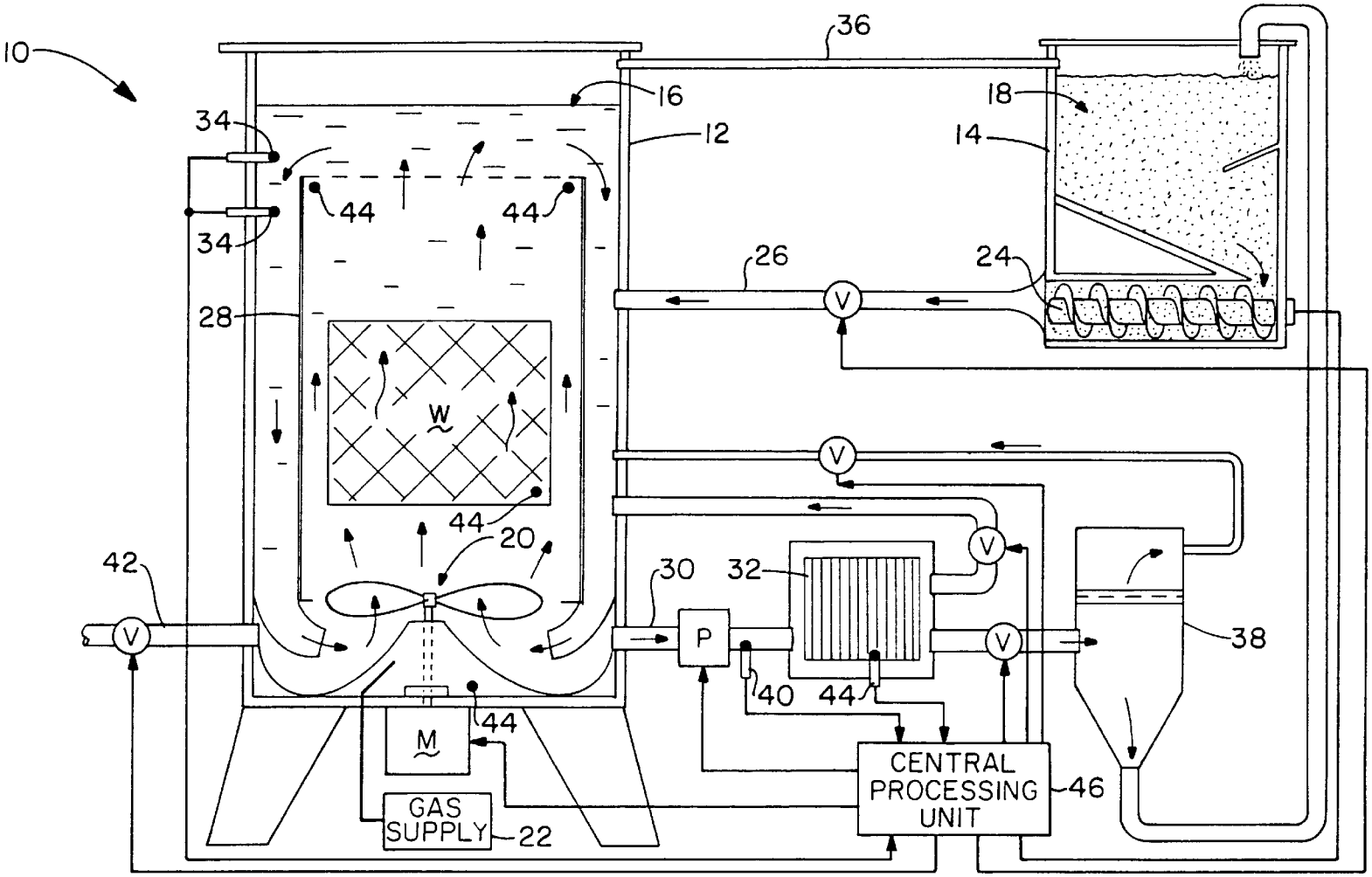
FIG. 2 shows a schematic diagram of the quench system of the present invention.

A quench system 10 of the present invention is shown schematically in FIG. 2. This system comprises a first tank 12 and a second tank 14. The first tank 12 is a quench tank in which the quenching operation is performed and it will be sized to accommodate a significant mass of a quenching liquid 16 as well as the material or workpiece W to be quenched. Also contained within the first or quench tank 12 are an agitation system 20 and a material handling device (not shown), such as an elevator or conveyor, to transport the materials to be quenched into and out of the tank. Both the agitation system 20 and the material handling device will be equipped with conventional operational controls, such as motors, speed controls and the like. A substantial portion of the volume of the first tank 12 will be filled with the quench liquid 16. In addition to the agitation system, preferred embodiments of the invention will include a gas injection system 22, typically comprising a pressurized gas supply external to the tank 12, a conduit to transmit the gas into the tank interior and an appropriate sparger for dispersing the gas in the lower portion of the tank.

Figure 1:
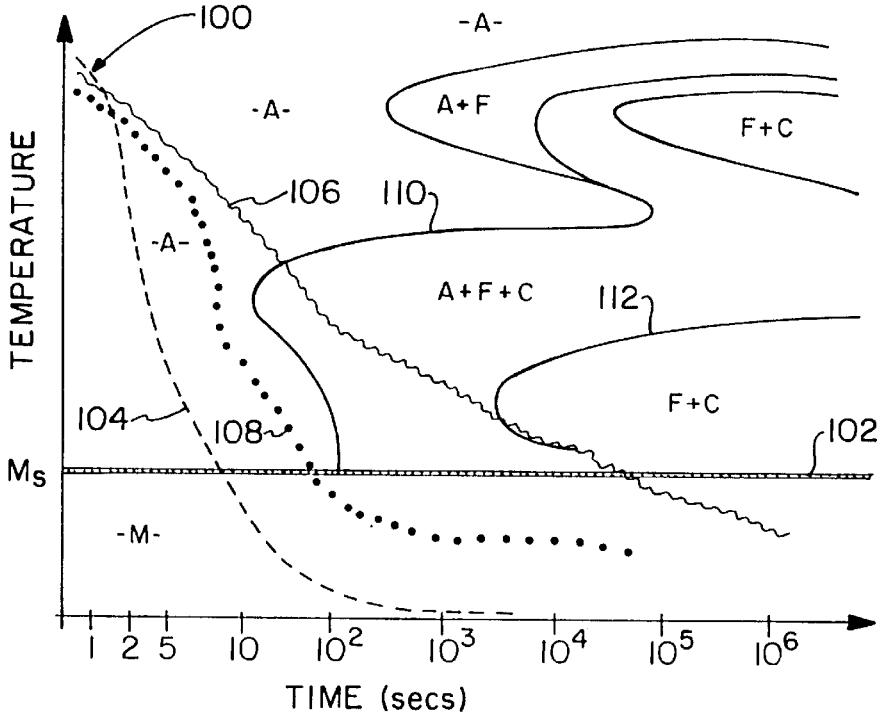
FIG. 1 shows a specimen isothermal transformation diagram for the cooling of a steel material.
Figure 3:
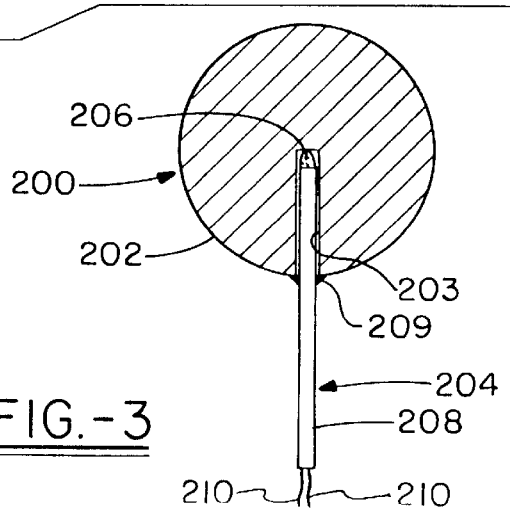
FIG. 3 shows a sectional view of a test element for generating cooling curve data.

The usual quench situation encountered in the first tank 12 is an initial rapid quench to assure hardness, followed by a slowed or retarded quench period, as shown in FIG. 1 as curve 104. Accordingly, the initial quench liquid in the first tank will preferably be a "fast" quench medium such as water, which possesses a sufficiently high heat extraction ability to achieve the initial desired quench rate.

The second tank 14 is selectively able to be communicated with the first tank 12 and is preferably located proximate to it. The second tank 14 contains a concentrated mass of quench retardant particles 18, preferably in a very concentrated slurry of the particles in an amount of the fast quench liquid. The quench retardant particles 18, when added to the fast quench medium 16, will temper or slow the heat extraction ability of the resultant mixture. In some cases, the quench retardant will comprise small polymeric particles or a polymer in solution. In other cases, the retardant will comprise small particles of metallic or non-metallic material. The particles will preferably be spherical or flaked and will preferably be on the order of 150 microns or less in diameter. The ability of the specific particles to mediate the quench rate of the fluid quench medium is in large part defined by the material utilized. For example, copper particles provide a high ability to extract heat where glass beads provide a much lower ability. Copper particles have the further attractive properties of being resistant to corrosion, generally available, recyclable, non-flammable, high melting point and low environmental risk. In addition to copper and glass, other quench retardant materials include steel shot, flaked steel shot or copper plated iron. This last retardant has the attractive combination of the heat extraction and corrosion resistance of copper with the ferromagnetic separation capability of iron. Unlike brine-type quenchants where the heat extraction ability of a base quenchant is modified by addition of a soluble salt, the quench retardants used in the present invention will be substantially insoluble in the quench medium, thereby reserving the ability to do a rapid and efficient solid-liquid separation when one needs to restore the base quenchant to its initial condition.

In the preferred embodiment of the invention, the bottom portion of the second tank 14 is provided with a feed means 24 for selectively allowing measured amounts of the retardant particles 18, preferably in the slurry form, to be introduced into the first tank 12 through a conduit 26 connecting the first and second tanks. A preferred device for this feed means 24 would be a fixed volume feed screw. In addition to monitoring and controlling the volume of particles 18 introduced, it will be preferred to monitor and control the temperature of the retardant particles introduced into the first tank.

The first tank 12 is equipped with other features one would expect in a cooling tank. It will have appropriate baffles 28 or the like to direct quenchant flow within the tank, according to flow paths established by the agitators. It will have a take-off loop 30 for removing a portion of the quenchant medium 16, passing it through a cooler 32 and returning it to the first tank 12. Heat extraction in this loop 30 is generally controlled by altering the mass flow rate of the quenchant through the loop. The particle size and characteristics of the retardants are important in keeping them dispersed in the quenchant and keeping them from fouling or contaminating the cooling surfaces in the loop. Temperature and flow rate monitors in this loop 30 provide valuable data points for control of the system. Level sensors 34 in tank 12 maintain the quenchant volume within an upper and lower limit and can be used to regulate make-up quenchant into the tank. An overflow capture system 36 is used to recover any overflow which occurs so that the retardant particles 18 contained in it may be recycled. A portion of the take-off loop 30 may also comprise a liquid-solid separator 38, such as a liquid cyclone, so that retardant particles 18 may be removed from the quenchant medium and reconcentrated to be fed into the system as needed. The most common usage of this liquid-solid separator 38 would be after the completion of a quench batch cycle, so that the liquid quenchant medium 16 can be restored to its initial "fast" quench condition prior to the commencement of a new quench cycle.

The mass of retardant particles 18 introduced into the first tank 12 is monitored by ascertaining the density of the quenchant 16 in the first tank. Since mass is the product of volume and density, and the volume introduced through the feed screw or other feed means 24 will be known, a density measuring means 40 in the first tank provides the information for calculating the mass. Likewise, the density in the first tank can be continuously monitored to track the introduction of the particles. The density measuring means 40 commonly used could include an ultrasonic density cell, a specific gravity cell or a percent solids cell. A typical density measuring means 40 useful in this application would be a CL-10 HYS DYNATROL cell, as is commercially available from Automation Products, Inc., of Houston, Tex. When a fixed volume feed screw 24 is used for feeding the particles, the number of revolutions of the screw will allow calculation of the feed volume.

The first tank 12 should also be equipped with the ability to introduce additional quench medium 16 into the tank to dilute the retardant concentration, if this would be required. Normally, this will not be needed during operation, but it may be needed on occasions if too much retardant were injected. This means 42 for injecting make-up quenchant would most commonly be used to adjust the quenchant level prior to commencing a quench.

The first tank 12 is also equipped with a plurality of temperature monitors 44 for determining the temperature at various points in the tank and in the material being quenched. A typical temperature monitor 44 will be a thermocouple, the exact composition determined by the temperature range of use.

Data generated by the retardant slurry feed means 24, the various temperature monitors 44, the speed of the one or more agitators 20 present in the first tank 12, and the density cells 40 are fed to a high speed data acquisition system 46. The elapsed time of the workpiece in the quenchant is also easily tracked by the high speed data acquisition system 46. A commercially available system known to be useful in this application is an HUPC607 or HUPC608 system, as is available from Controls International. Such systems are capable of handling the acquisition of thousands of data points per second from inputs such as thermocouples. In such a data acquisition system 46, the data are used to generate a real time quenchant cooling curve. This generated curve may be compared against the known isothermal transformation diagram of the type shown in FIG. 1 and the ideal quenchant curve for a given part. Known and conventional feedback control technology may be used to take corrective action based on observed deviations of the real time quenchant curve from the ideal curve.

The advantage of the present invention quench system 10 is the ability to alter the heat extraction index of a liquid quenchant 16 during a quench operation in a generally continuous manner, that is, without need to withdraw the workpiece or to make a complete changeout of the quenchant. The heat extraction index is a relative measure of the ability of the quenchant to remove thermal energy from a part, with water typically being referenced as having a heat extraction index of 1. A further advantage is that the nature of the quench retardants 18 used are such that are readily separable from the base quench medium 16 at the end of the batch process.

Figure 4:
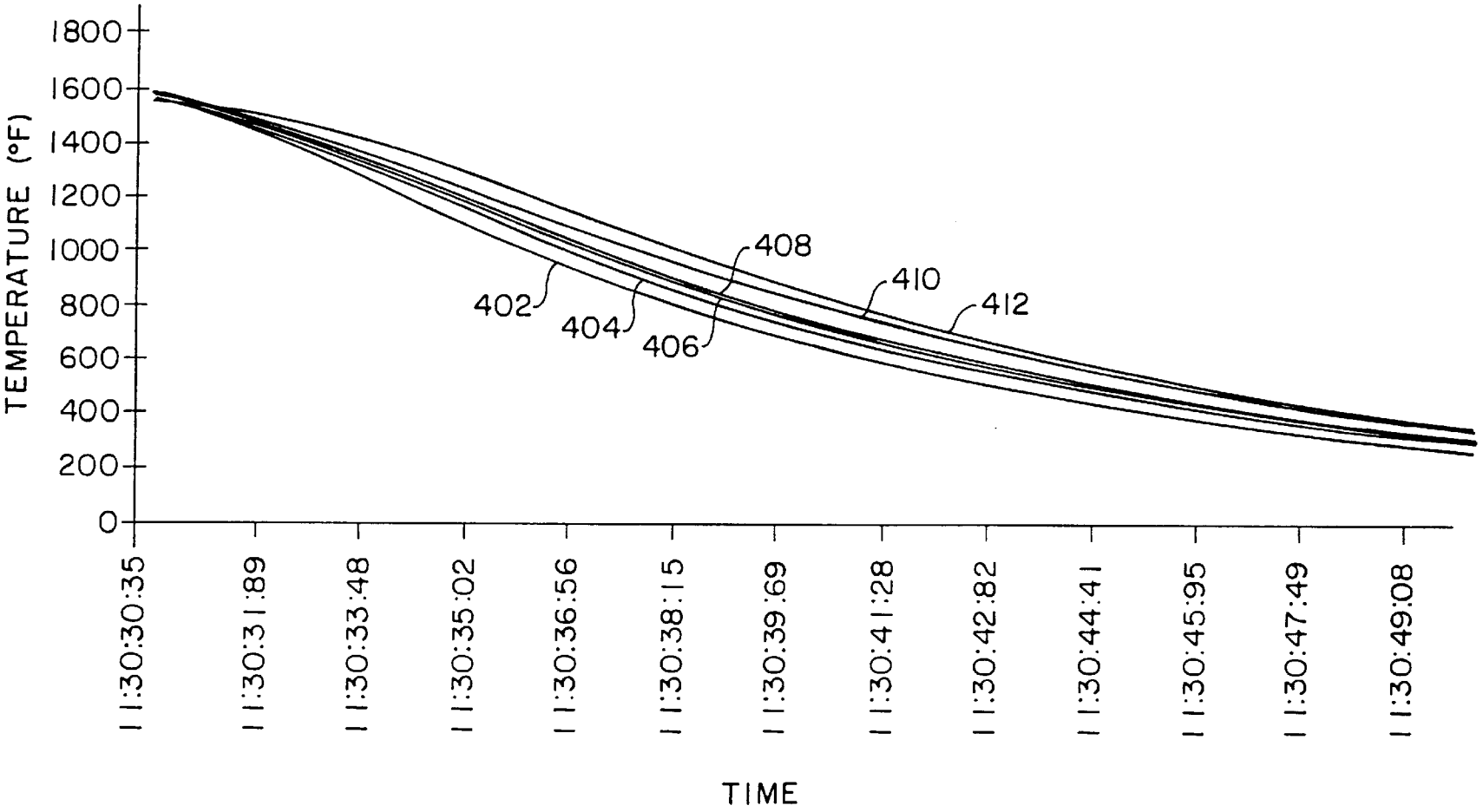
FIG. 4 shows typical cooling curve data for a quench tank using various quench retardants.

The heat extraction characteristics of a given quench system 10 and particularly the quench tank 12 may be measured by the generation of data by cooling a plurality of test elements 200 in the tank. A test element 200 which is particularly preferred by the inventor is a metal sphere 202. The preferred diameter is about 1 inch, although the use of different diameters provides the ability to determine the cooling rate at various depths into a workpiece. The preferred material for testing a quench system for steels of the type being discussed is a Series 300 stainless steel, because such a metal sphere 202 would not undergo phase transformations, thereby eliminating the need to adjust for the exothermicities or endothermicities associated with the phase changes. In such a metal sphere 202, a hole 203 is bored to the center and a thermocouple 204 of an appropriate type having a bimetallic couple 206 at the end of a sheath 208 is inserted so that the couple is in thermal contact with the center of the sphere 202 and the sheath is brazed as shown at 209 to the external surface of the sphere. A pair of electrical leads 210 run through the sheath 208 to the couple 206 and are shown extending outwardly beyond the end of the sheath. A test element 200 of this type can be heated in a furnace until an appropriate center temperature is reached, as determined by a reading of the couple potential. The test element 200 may then be inserted into the quench tank 12 and the cooling characteristics of the element may be observed in conjunction with the operating quench system 10. These data may be used to infer the cooling characteristics of a workpiece at a depth of one test element radius, that is, at one-half inch in the case of a one inch diameter sphere 202. As the sphere 202 used gets increasingly larger, the size of the thermocouple relative to the sphere gets increasingly smaller and the results obtained are more reliable. FIG. 4 shows a set of cooling curves obtained in a typical test using a one-inch diameter Series 300 stainless steel ball test element 200, heated to 1600 degrees F. and cooled in a water bath. Six representative cooling curves are shown in FIG. 4. In the first curve 402, a water quenchant is used and cooling over about 19 seconds is shown. Curve 404 shows the cooling of an identical test element in a water quenchant with a soluble surfactant added. Curve 406 shows the cooling of an identical test element in a water quenchant into which a quench retardant, namely a quantity of copper particles, has been added. Curve 408 shows the cooling of an identical test element in the same water quenchant as in curve 402, but with an increased agitator speed, to reflect the ability of agitator speed to influence heat extraction. Curve 410 shows the cooling of an identical test element in a water quenchant containing approximately twice as many copper particles as in curve 406. The sixth curve, designated 412 in FIG. 4, represents a reproduction of the quenchant used in curve 410. The results shown should be interpreted qualitatively only, but they show that the addition of the quench retardants act much more effectively than a surfactant at reducing the slope of the cooling curve, thereby more closely imitating an ideal quenchant. While the horizontal time axis is presented linearly rather than logarithmically, the short time interval represented makes this difference negligible.

The preferred practice of the invention would be to begin a quench process of a workpiece by inserting the workpiece into a "base" or initial quench medium with a high heat extraction index, typically water, although a slower quenchant may be desired in some operations. As the quench begins and data are collected and compared against the known isothermal transformation curve for a given set of tank conditions, deviations from the ideal curve can be observed and tracked. Correction of the deviations is used to maintain the cooling process along an ideal curve, particularly by lowering the effective heat extraction index by injecting retardant particles, insoluble and/or soluble polymer. Additionally, the quenchant temperature or the agitation characteristics may be altered in real time to adjust to observed data. Because the retardant particles are so easily separated from the base quenchant and can be easily removed from the workpiece at the end of the operation, drag out after quenching is greatly minimized. If necessary, the quench bath can be reaccelerated in real time by diluting the retardant particle concentration through addition of make up base quench medium or separation of retardant particles using the solid-liquid separator loop. In addition to this loop, the ferromagnetic properties of some retardant particles may be utilized separate and collect these particles. At the end of a quench cycle, the restoration of the base quench medium to its initial condition by the use of these separation techniques should permit a rapid return of the quench medium to its initial composition so that the next quench cycle may be commenced with a new workpiece.

In some embodiments of this process, it may be desirable to inject a gaseous substance, particularly a non-soluble gaseous substance which has nitrogen as its major component, into the quench tank to modify the cooling rate, as through the gas injection system 22 described above. It will be readily understood that the injection of such a substance is particularly useful in a quench tank of this type, since the effect provided by the injection on the cooling rate can be turned "on" and "off" very easily by adding or removing the gas injection, and the overall effect of the gas will be very transient, depending only upon the residence time required for flow of the gas through the tank. The use of an essentially insoluble gas is preferred in that it does not chemically alter the quench medium after the gas injection has been stopped. Injection of a soluble gas, such as carbon dioxide, would affect the pH of the quench medium for an extensive time after its use.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A process for quenching a workpiece of a known material, comprising the steps of:

a) inserting the workpiece into a quench tank containing an initial charge of a liquid quenchant having an initial temperature, density and heat extraction index;

b) repeating at least once the following steps at a predetermined time interval:

1) collecting at least one set of data points from the tank, comprising quenchant temperature and density data points;

2) calculating an instantaneous heat extraction index based upon the set of data points and calculating a deviation of the instantaneous heat extraction index at the known elapsed time from an ideal heat extraction index for the same elapsed time of quenching the material;

3) taking corrective action to decrease the deviation; and c) removing the workpiece from the quenchant when a predetermined quench cycle is complete.

2. The process of claim 1 wherein the corrective action comprises adding an amount of a non-liquid quenchant modifier to the liquid quenchant.

3. The process of claim 2 wherein the non-liquid quenchant modifier is a finely divided solid which decreases the heat extraction index.

4. The process of claim 3 wherein non-liquid quenchant modifier is essentially insoluble in the liquid quenchant.

5. The process of claim 2 wherein the non-liquid quenchant modifier is a gas which is essentially insoluble in the liquid quenchant and which is injected into the bottom of the quench tank and allowed to bubble therethrough.

6. The process of claim 2 wherein the major component of the gas is nitrogen.

7. The process of claim 2 wherein the non-liquid quenchant modifier is added as a slurry of the modifier in an amount of the liquid quenchant.

8. The process of claim 1 wherein the process further comprises the step of reconstituting the liquid quenchant to its initial temperature, density and heat extraction index after the completion of step c), the reconstituting step achieved by passing the liquid quenchant through flow integral to the tank.

9. The process of claim 8 wherein the flow loop comprises a heat exchanger and a solid-liquid separator.

10. The process of claim 9 wherein the solid-liquid separator comprises a vortex- or cyclone-type separator.

11. The process of claim 9 wherein the solid-liquid separator comprises a magnetic separator.

12. The process of claim 1 wherein step b) is achieved through the use of a real time data acquisition and analysis device.

13. An apparatus for variable rate cooling of a heated workpiece of a known material using a liquid quenchant having an initial temperature, density and heat extraction index, said device comprising:

a first tank containing the liquid quenchant and to receive the workpiece;

means for agitating the liquid quenchant in the first tank around the workpiece;

a second tank communicated to said first tank, the second tank containing a slurry of a non-liquid solid phase quenchant modifier in an amount of the liquid quenchant;

a supply of make-up liquid quenchant communicated to the first tank;

means for selectively controlling addition of the slurry to the first tank;

means for acquiring and analyzing in real time the temperature, density and agitation rate of the liquid quenchant;

means for calculating an instantaneous heat extraction index of the liquid quenchant, comparing the difference between the calculated index and a predetermined ideal index;

means for reducing the difference by selectively adding either make-up liquid quenchant from the supply thereof or slurry from the second tank; and means for cycling a portion of the quenchant in the first tank through a heat exchanger external to the first tank.

* * * * *